US007515106B2

(12) United States Patent
Brosnan

(10) Patent No.: US 7,515,106 B2
(45) Date of Patent: Apr. 7, 2009

(54) NON-RESONANT ANTENNAS EMBEDDED IN WIRELESS PERIPHERALS

(75) Inventor: Michael J. Brosnan, Fremont, CA (US)

(73) Assignee: Avago Technologies General IP (Singapore) Pte. Ltd., Sinapore (SG)

( * ) Notice: Subject to any disclaimer, the term of this patent is extended or adjusted under 35 U.S.C. 154(b) by 570 days.

(21) Appl. No.: 11/025,215

(22) Filed: Dec. 29, 2004

(65) Prior Publication Data

US 2006/0141958 A1 Jun. 29, 2006

(51) Int. Cl.
*H01Q 1/38* (2006.01)
*H01Q 1/40* (2006.01)

(52) U.S. Cl. ..... 343/700 MS; 343/873

(58) Field of Classification Search ..... 343/700, 343/873, 872, 700 MS, 702, 866
See application file for complete search history.

(56) References Cited

U.S. PATENT DOCUMENTS

| | | | | |
|---|---|---|---|---|
| 5,854,621 | A | 12/1998 | Junod et al. | |
| 6,061,251 | A | 5/2000 | Hutchison et al. | |
| 6,236,366 | B1 | 5/2001 | Yamamoto et al. | |
| 6,285,324 | B1 * | 9/2001 | Korisch et al. | 343/700 MS |
| 6,353,443 | B1 | 3/2002 | Ying | |
| 6,373,447 | B1 * | 4/2002 | Rostoker et al. | 343/895 |
| 6,531,740 | B2 * | 3/2003 | Bosco et al. | 257/347 |
| 6,582,979 | B2 * | 6/2003 | Coccioli et al. | 438/25 |
| 6,770,955 | B1 * | 8/2004 | Coccioli et al. | 257/659 |
| 6,806,565 | B2 | 10/2004 | Chen et al. | |
| 6,828,660 | B2 * | 12/2004 | Abbott | 257/666 |
| 7,038,635 | B2 * | 5/2006 | Fukushima et al. | 343/895 |
| 7,098,850 | B2 * | 8/2006 | King et al. | 343/700 MS |
| 2004/0130532 | A1 | 7/2004 | Gordon et al. | |
| 2004/0196190 | A1 | 10/2004 | Mendolia et al. | |

FOREIGN PATENT DOCUMENTS

| | | |
|---|---|---|
| JP | 2002-141735 | 10/2000 |
| WO | WO 02/063715 A1 | 8/2002 |

OTHER PUBLICATIONS

James W. Healy, "Antenna Here is a Dipole," QST, Jun. 1991, pp. 23-26.
Griffin et al., "Electromagnetic design aspects of packages for phased array modules that may incorporate monolithic antenna elements," IEEE, 2004.
Shamim et al., "SI Monolithic Antenna Calibration and De-embedding Considerations," ANTEM, Jul. 20-23, 2004.
Telos Ultra low power IEEE 802.15.4 compliant wireless sensor module—Revision A: Humidity, Light, and Temperature Sensors with USB. Moteiv Corporation, Jul. 14, 2004, pp. 1-25.
R. Colin Johnson, "Wireless Transceiver-on-chip now possible, team says," EE Times, Aug. 9, 2004, pp. 1-4.
Lin et al., "Integrated Antennas on Silicon Substrates for Communication over Free Space," IEEE, Apr. 2004, pp. 196-198.

(Continued)

*Primary Examiner*—Shih-Chao Chen

(57) ABSTRACT

A peripheral apparatus includes a housing, a semiconductor device, and an antenna. The peripheral apparatus generates and transmits radio frequency (RF) control signals to a host device. The semiconductor device is contained within the housing and generates the RF control signals. The antenna is fully contained within the semiconductor device and transmits the RF control signals to the host device.

12 Claims, 3 Drawing Sheets

OTHER PUBLICATIONS

Shamim et al., "24 GHz Differential Integrated Antennas in 10 amps-cm Bulk Silicon Technology," Department of Electronics, Carleton University, Ottawa, Canada.

Data Sheet—Agilent ADNS-2030 Low Power Optical Mouse Sensor, pp. 1-5.

* cited by examiner

NON-RESONANT ANTENNAS EMBEDDED IN WIRELESS PERIPHERALS

BACKGROUND

Various techniques have been provided for connection of peripherals devices to personal computers, workstations and related host devices. Traditionally, a common approach was a cable connection from the peripheral device to a standard serial or parallel port provided in the host device. In addition, some techniques have been used for providing wireless communication between the peripheral device and the host device. Some such wireless techniques have involved infrared transmitters and receivers. Other wireless techniques have involved radio frequency (RF) communication links.

Such wireless peripheral devices using RF links typically include a loop antenna formed on or even in a printed circuit board contained within the peripheral device. For example, a wireless mouse may include a mouse printed circuit board having a loop antenna formed directly on its surface. When such a device is operated, for example, at 27 MHz, the loop antenna formed on the printed circuit board may be 30 millimeters×60 millimeters. A 27 MHz antenna with such dimensions provides a good signal from a peripheral device located in relative proximity to the host device, for example, when they are separated by less than 1-2 meters.

Such antennas will, however, include resistive losses. Even where attempts are made to match the impedance of the RF transmitter to the impedance of the antenna, there will always be resistive losses in series with the antenna connection. In fact, there will be losses in series with the antenna itself. Such resistive losses include the resistance of the metal trace forming the antenna and include the skin effect in which current is forced to flow in a thin layer of metal near the surface of the printed circuit board at high frequencies.

Some wireless peripheral devices have also operated at higher frequencies, such as 2.4 GHz. These higher frequency devices, however, have not had significant practical success as peripheral devices. In part, this is due to the increased power consumption of these higher frequency devices compared to the relatively lower frequency devices, such as 27 MHz devices. In addition, such devices are typically somewhat complex and thus expensive. These higher frequency devices in the gigahertz range typically require significant impedance control due to running radio frequency signals from one place to another on a circuit board. In addition, all leads typically must be shielded and kept as short as possible, and the dimensions of all signal traces much be controlled as tightly as possible, to prevent reflections or power loss. Such requirements typically can not be made for low cost and low power requirements of many applications.

For this and other reasons, a need exists for the present invention.

SUMMARY

One aspect of the present invention provides a peripheral apparatus for use with a host device. The peripheral apparatus includes a housing, a semiconductor device, and an antenna. The peripheral apparatus generates and transmits radio frequency (RF) control signals to a host device. The semiconductor device is contained within the housing and generates the RF control signals. The antenna is fully contained within the semiconductor device and transmits the RF control signals to the host device.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principles of the invention. Other embodiments of the present invention and many of the intended advantages of the present invention will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims.

Figure 1:
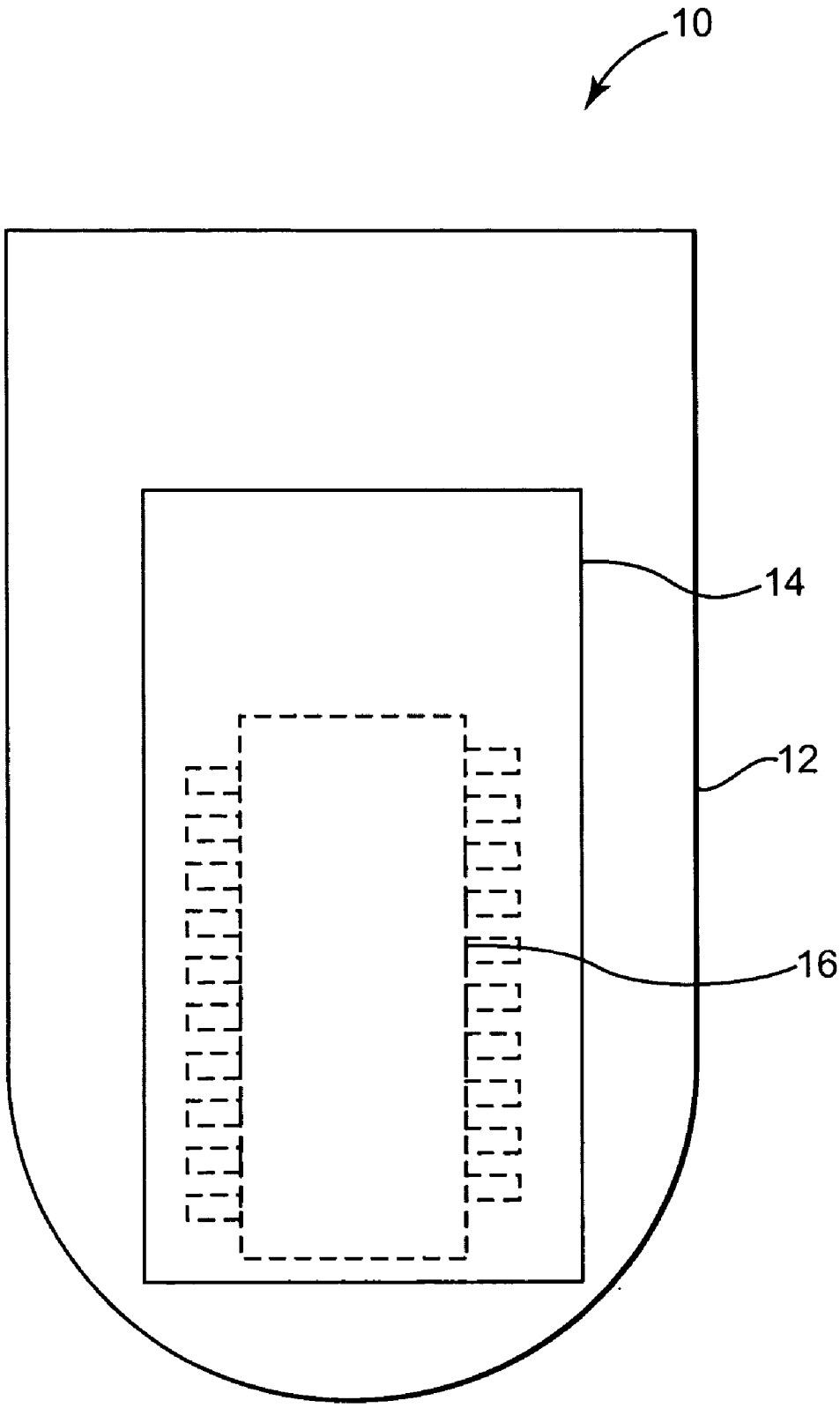
FIG. 1 illustrates a top view of the peripheral device according to one embodiment of the present invention.

FIG. 1 illustrates a wireless peripheral device 10 in accordance with one embodiment of the present invention. Wireless peripheral device 10 includes a housing 12, a printed circuit board 14, and semiconductor chip 16. In one embodiment, wireless peripheral device 10 is a wireless mouse that is connectable to a personal computer for controlling the pointer on the personal computer. In other embodiments, wireless peripheral device 10 may comprise other peripherals such as, track balls, keyboards, digitizing tables, etc. In each case, wireless peripheral device 10 is in communication with computer, workstation or related host device to send control information to the host device. For example, where wireless peripheral device 10 is a wireless mouse, it will send control information for controlling the position of a screen pointer on the host computer. Wireless peripheral device 10 utilizes a radio frequency ("RF") transmitter and receiver pair to transmit control information, which eliminates the need for a cable connection between the peripheral device and the host device.

In one embodiment where wireless peripheral device 10 is a wireless mouse, semiconductor chip 16 is a navigation sensor that receives optical signals that are reflected below the optical mouse. A number of such navigation sensor semiconductor chips are available for optical mouse applications. One such optical navigation sensor chip is the ADNS-2030 from Agilent Technologies. Such a navigation sensor uses a non-mechanical tracking engine for computer mice. The navigation sensor measures changes in position of the mouse by optically acquiring sequential surface images or frames and mathematically calculating the direction and magnitude of movement.

In prior art applications such as the ADNS-2030 navigation sensor chip, signals within the navigation sensor that indicate direction and magnitude of movement are sent from the chip, through a microcontroller and additional circuitry, to a loop or similar antenna that is provided on or in printed circuit board 14. In this way, navigation control information from semiconductor chip 16 is transmitted to the antenna on circuit board 14, and then via the antenna to a receiver residing in the host device, which is in communication with wireless peripheral device 10. The loop antenna formed on the printed circuit board may be on the order of a 2-inch diameter loop antenna. For example, a 30 millimeters×60 millimeters loop antenna may be formed as a trace on the printed circuit board. For 2.4 GHz applications, such an antenna could be formed on the printed circuit board so that it is resonant and would function very well in transmitting RF signals in the relatively close proximity of the peripheral device to the host device, especially in instances where they are separated by only a couple meters or less.

Semiconductor chip 16 in accordance with the present invention, however, also includes an embedded antenna such that no antenna is required on printed circuit board 14. In this way, control signals within the semiconductor chip 16 are not required to be routed out of chip 16 and to printed circuit board 14 before being sent to the host device. Rather, the control signals are transmitted directly via RF signals to the host device from within semiconductor chip 16.

Thus, in the case of a wireless mouse application where semiconductor chip 16 is a navigation sensor, an antenna for transmitting RF signals is embedded within the navigation sensor chip. The control signals within the navigation sensor that indicate direction and magnitude of movement are thus transmitted via RF signals to the host device.

Figure 2:
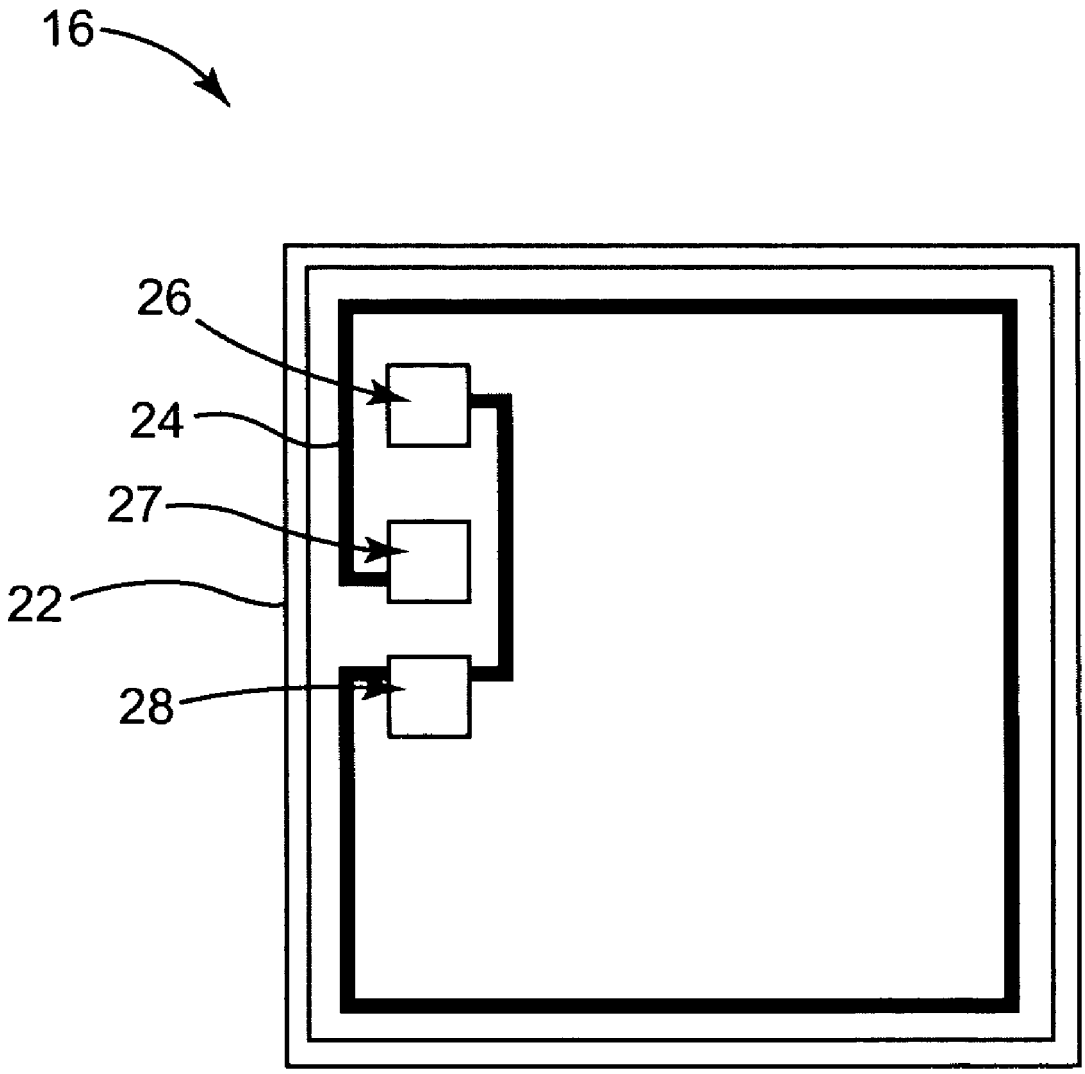
FIG. 2 illustrates a top view of a monolithic antenna formed on a silicon layer in accordance with one embodiment of the present invention.

FIG. 2 illustrates a portion of semiconductor chip 16 from FIG. 1 with a fully integrated antenna 24 in accordance with one embodiment of the present invention. Semiconductor chip 16 is comprised of a plurality of semiconductor layers and metallization layers. Certain portions of semiconductor chip 16 are removed in FIG. 2 to illustrate semiconductor layer 22 on which antenna 24 is embedded. Antenna 24 is deposited around the periphery of chip 16 adjacent semiconductor layer 22. In one embodiment, antenna 24 is formed in a metallization layer of semiconductor chip 16 adjacent semiconductor layer 22. In this way, antenna 24 is a monolithic antenna in semiconductor chip 16.

First, second and third antenna terminal pads 26, 27, and 28 are electrically coupled to antenna 24. In one embodiment, third antenna pad 28 is connected through a via in semiconductor layer 22 to ground or to a substrate layer. Consequently, the end of antenna 24 coupled to first and third terminal pads 26 and 28 are ground for antenna 24. A drive signal for antenna 24 is then provided to second terminal pad 27. In this embodiment, three terminals rather two were implemented to facilitate measurements with commercially available probing equipment. It is understood that terminal pads 26 and 28 could be combined into one node and that probe pads, although convenient for measurement, are not needed in order to transmit RF energy from monolithic circuitry and antenna combinations.

In operation, control signals generated within semiconductor chip 16 of wireless peripheral device 10 are driven to second terminal pad 27 of antenna 24. In this way, the control signals are transmitted directly via RF signals on antenna 24 to the host device, all from within semiconductor chip 16.

Moving an antenna from printed circuit board 14 to within semiconductor chip 16 is in many ways counterintuitive. The signal strength of the RF signals transmitted via the antenna is a function of the relative length of the antenna to the wavelength of the transmitted signal. In many peripheral-to-host wireless applications, such as in a wireless mouse application, a resonant antenna is desired. Such an antenna is configured such that the length of the antenna is at least one quarter the wavelength of the transmitted signal. In many current wireless mouse applications, 27 MHz is a common frequency such that the corresponding wavelength of the signals is on the order of 11 meters. Consequently, the antenna for such wireless mouse applications has been placed on the printed circuit board where there is sufficient space only for an antenna with a small length to wavelength ratio. At the 2.4 GHz frequency used in some wireless mouse applications, the corresponding wavelength of the signals is on the order of 5 inches, and resonant antennas have been placed on the printed circuit board where there is often sufficient space to accommodate them.

Antenna 24 of the present invention, however, is embedded within semiconductor chip 16. In one embodiment of semiconductor chip 16, the dimensions of antenna 24 are limited by the size of the periphery of semiconductor layer 22 around which antenna 24 extends. In one embodiment, the periphery of semiconductor layer 22 is on the order of approximately 3 millimeters by 5 millimeters. Thus, the edge length of the antenna makes it nearly impossible to create a resonant antenna within that space. However, with the present invention, a sufficient non-resonant antenna 24 may be created that operates well enough and provides additional advantages. Although antenna 24 is particularly small, it still has enough length to represent a significant enough percentage of the transmitting wavelength to function sufficiently.

For example, connections normally needed to bring signals to an antenna outside the chip are no longer needed. In one embodiment, in addition to including a plurality of semiconductor layers, semiconductor chip 16 also includes a plurality of metallization layers. The metallization layers, which may for example be a plurality of aluminum layers, interconnect signals within the semiconductor chip 16. A plurality of wire bonds then carry signals within the chip outside the chip. Rather than rely on such wire bonds, one embodiment of the invention forms antenna 24 with the metallization layers themselves such that they form a conductive loop that may drive antenna 24 with an RF transmitter. In this way, no wire bonds or connections would be needed to couple signals into antenna 24. This will limit signal loss and impedance problems associated with routing signals off semiconductor chip 16 to an antenna located on printed circuit board 14.

In order to lengthen antenna 24, thereby strengthening the RF signals produced, antenna 24 may be configured on several metallization layers. In some cases, as many as five metallization layers may be used. In addition, by making antenna 24 a spiral antenna on one or more of the layers, additional length may be added.

In an embodiment where wireless peripheral device 10 is a wireless mouse, peripheral device 10 will be in relatively close proximity to the host device, which in one case is a computer. In many applications, wireless peripheral devices 10, like wireless mice, are separated from the host device computer by only a meter or two. In such cases, even where antenna 24 is non-resonant based on its length and the 27 MHz or 2.4 GHz transmitting frequency, for example, the length of antenna 24 is still enough to represent a significant enough percentage of the transmitting wavelength to function sufficiently.

Figure 3:
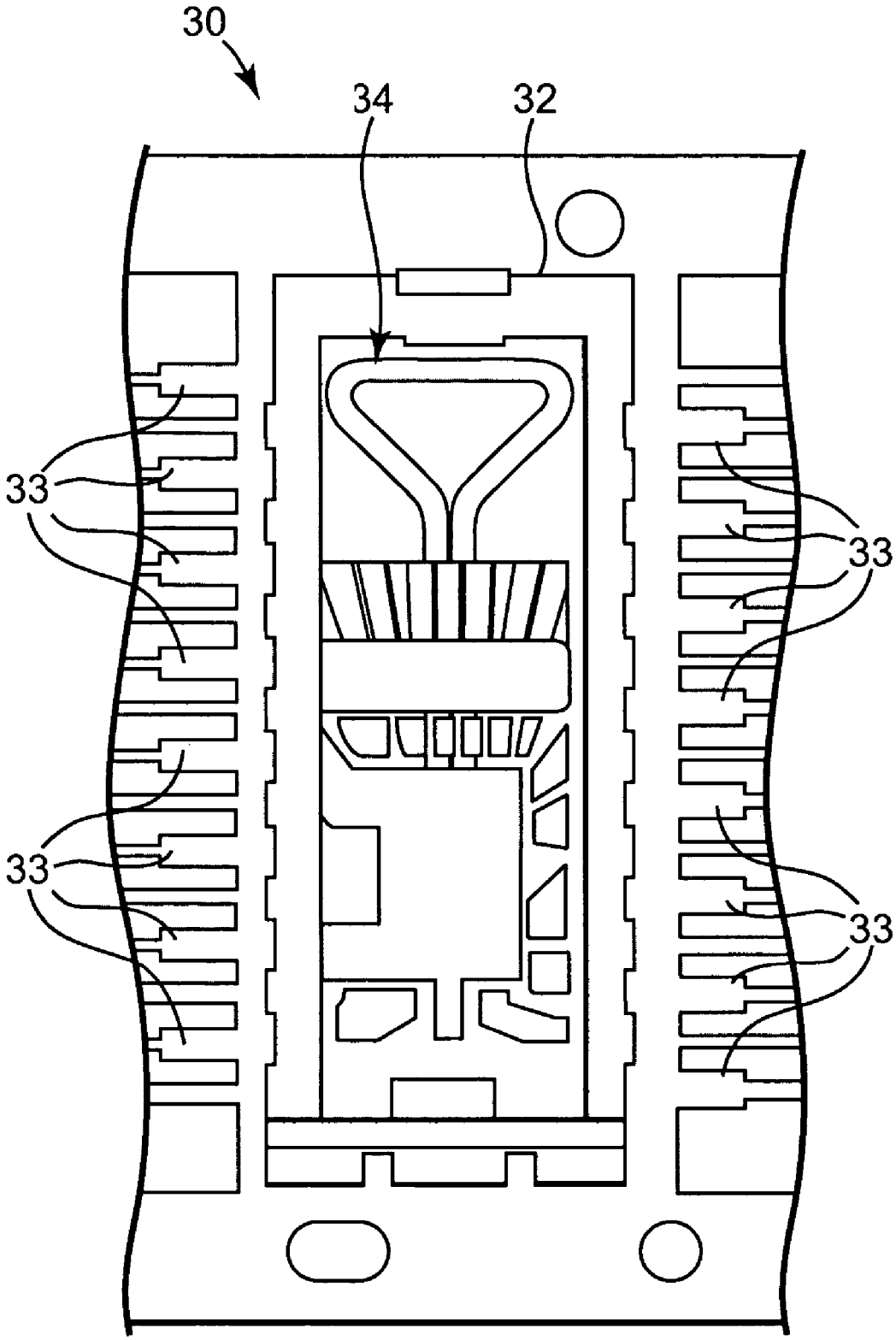
FIG. 3 illustrates an antenna formed internal to a leadframe package with accordance with one embodiment of the present invention.

FIG. 3 illustrates portions of semiconductor chip 16 from FIG. 1 during its fabrication. A portion of a leadframe 30 is illustrated, on which a plurality of semiconductor chips, such as semiconductor chip 16, may be attached. A main body 32 of leadframe 30 is illustrated with a plurality of leads 33 extending out therefrom. The leads 33 extending out from main body 32 are illustrated interspersed with leads from adjacent main bodies (not illustrated in FIG. 3). As is well known in the art, after semiconductor chip 16 is attached on leadframe 30, each individual leadframe package is separated. Then the plurality of leads 33 may be bent for attachment to a printed circuit board or similar mechanism.

Unlike conventional chip attachment on a leadframe 30, however, main body 32 has a fully integrated antenna 34 in accordance with one embodiment of the present invention. In one embodiment, antenna 34 is formed simultaneously with main body 32 of leadframe 30, as illustrated in FIG. 3, before semiconductor devices are attached on leadframe 30. In this way, similarly to the previously-described monolithic antenna 24, antenna 34 is fully integrated with packaged semiconductor chip 16. Consequently, signal loss and impedance problems associated with routing signals off semiconductor chip 16 to an antenna located on printed circuit board 14 are avoided.

Embedding antenna 34 on leadframe 30 has an advantage of providing additional space compared to the monolithic antenna described above. In one embodiment, a semiconductor package is approximately an inch long and 0.6 inches wide such that main body 32 of leadframe 30 provides approximately 0.5×0.5 inches of space within which to form antenna 34. Antenna 34 could be made round, square or other shaped within that space to provide an antenna having a length that amounts to a sufficient fraction of the signal wavelength. In this way, even though antenna 34 is non-resonant based on its length compared to the transmitting frequency (for example, 27 MHz or 2.4 GHz) the length of antenna 24 is still enough to represent a significant enough percentage of the transmitting wavelength to function sufficiently.

Since antenna 34 is formed on leadframe 30, it will have wirebonds or similar connectors to route the signals to be transmitted to antenna 34. Such connections will add slightly to signal loss and impedance variation beyond that experienced in the monolithic antenna 24 described above. There may also be some variation from chip to chip compared to the monolithic antenna 24, because there the lithography or similar process used to form antenna 24 in the metallization layer is more precisely controllable than is the wirebond or similar connector process used in conjunction with antenna 34. In any case, the embedding of antenna 34 on leadframe 30 still avoids the signal loss and impedance problems associated with routing signals off semiconductor chip 16 to an antenna located on printed circuit board 14.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A peripheral apparatus for generating and transmitting radio frequency (RF) control signals to a host device, the peripheral apparatus comprising:

a housing;

a semiconductor device contained within the housing and that generates and sends the RF control signals, wherein the semiconductor device further comprises a leadframe and a plurality of semiconductor layers formed on the leadframe; and an antenna fully contained within the semiconductor device for transmitting the RF control signals to the host device, wherein the antenna is formed directly on the leadframe, and wherein the antenna comprises a metal trace formed in contact with a layer of the leadframe.

2. The apparatus of claim 1, wherein the semiconductor device further comprises a plurality of semiconductor layers, and including at least one metal layer.

3. The apparatus of claim 1, wherein the antenna is formed within a 5 millimeter×5 millimeter space of the semiconductor device.

4. The apparatus of claim 1, wherein the antenna has a total length between 30 millimeters and 300 millimeters.

5. The apparatus of claim 4, wherein the sending RF control signals are transmitted at a frequency between 27 MHz and 2.4 GHz.

6. The apparatus of claim 1, wherein the antenna is formed within a 12 millimeter×12 millimeter space of the leadframe.

7. The apparatus of claim 1, wherein the antenna is a loop antenna having a total length between 100 millimeters and 500 millimeters.

8. The apparatus of claim 7, wherein the sending RF control signals are transmitted at a frequency between 27 MHz and 2.4 GHz.

9. The apparatus of claim 1, wherein the antenna is a loop antenna with a plurality of loops.

10. A peripheral apparatus comprising:

a peripheral apparatus housing; and a semiconductor device mounted within the peripheral apparatus housing for generating and sending radio frequency (RF) control signals to a host device, the semiconductor device further comprising:

a leadframe;

a plurality of semiconductor layers;

a plurality of metallization layers;

an antenna, wherein the antenna is formed directly on the leadframe, and wherein the antenna comprises a metal trace formed in contact with a layer of the leadframe; and a plastic housing containing the leadframe, the plurality of semiconductor layers, and the antenna.

11. The apparatus of claim 10, wherein the sending RF control signals are transmitted at a frequency between 27 MHz and 2.4 GHz.

12. A method for fabricating a semiconductor device for use in a peripheral device that generates and sends radio frequency (RF) control signals to a host device, the method comprising:

providing a leadframe;

attaching a semiconductor chip with layers of semiconductor material onto the leadframe;

providing metallization layers;

fabricating an antenna on the leadframe, wherein the antenna comprises a metal trace formed in contact with a layer of the leadframe; and encapsulating the leadframe, the semiconductor chip, the metallization layers, and the antenna in a plastic housing.

* * * * *